United States Patent [19]

Kobayashi et al.

[11] Patent Number: 4,770,021

[45] Date of Patent: Sep. 13, 1988

[54] WORKING ROLL SHIFT TYPE ROLLING MILL

[75] Inventors: Kazuo Kobayashi; Tokuji Sugiyama, both of Ibaraki; Hiroshi Ando, Hitachi, all of Japan

[73] Assignee: Hitachi, Ltd., Tokyo, Japan

[21] Appl. No.: 28,137

[22] Filed: Mar. 19, 1987

[30] Foreign Application Priority Data

Mar. 20, 1986 [JP] Japan ..... 61-63521

[51] Int. Cl.[4] ..... B21B 31/18; B21B 31/10; B21B 31/32

[52] U.S. Cl. ..... 72/247; 72/238; 72/243; 72/245

[58] Field of Search ..... 72/247, 245, 243, 20, 72/21, 241, 238, 239

[56] References Cited

U.S. PATENT DOCUMENTS 3,024,679 3/1962 Fox ..... 72/243
3,857,268 12/1974 Kajiwaka ..... 72/247

FOREIGN PATENT DOCUMENTS 67040 12/1982 European Pat. Off. .
112969 9/1983 European Pat. Off. .
3331055 3/1985 Fed. Rep. of Germany .
3409221 9/1985 Fed. Rep. of Germany .
0108864 9/1978 Japan ..... 72/241
0202910 12/1982 Japan ..... 72/247
0153505 9/1984 Japan ..... 72/247
0006212 1/1985 Japan ..... 72/247

*Primary Examiner*—Robert L. Spruill
*Assistant Examiner*—Steven B. Katz
*Attorney, Agent, or Firm*—Fay, Sharpe, Beall, Fagan, Minnich & McKee

[57] ABSTRACT

A working roll shift type rolling mill has a housing including upper and lower working rolls having working roll chocks, and upper and lower reinforcing rolls having reinforcing roll chocks. Hydraulic rams mounted between the upper and lower working roll chocks apply a vertical force to the vertically facing portions of the respective chocks. The working roll chocks are immovably mounted on their respective working rolls so that they can be moved together. Each of the hydraulic rams has one end mounted in one of the upper or lower working roll chocks and the other end engaging the horizontal wall surfaces of the upper and lower working roll chocks that are vertically adjacent to each other. The working roll chocks and reinforcing roll chocks have flat side surfaces. The housing of the rolling mill includes windows each having a flat side wall such that the working roll chocks and the reinforcing roll chocks may be lifted and lowered within the housing.

8 Claims, 6 Drawing Sheets

WORKING ROLL SHIFT TYPE ROLLING MILL

BACKGROUND OF THE INVENTION

1. Field of the Invention

The present invention relates generally to a rolling mill having a roll arrangement in which working rolls are respectively shifted along the axes thereof in accordance with various rolling conditions and more particularly to a rolling mill used for rolling hot strip materials having a roll arrangement in which the respective working rolls are provided with working-roll bending devices and reinforcing rolls for supporting the working rolls.

2. Description of the Prior Art

In the field of rolling production, there has recently been a strong demand for schedule free rolling and improvements in the quality of rolled products. In response to this demand, the accuracy of thickness of rolled sheet material in its longitudinal direction has been improved to a significant degree by virtue of the development of automatic sheet thickness control. As a known example, U.S. Pat. No. 3024679 discloses a working roll bending method adapted for quadruple rolling mills. this method has been proposed as a means for improving the accuracy of thickness (flatness) of rolled sheet materials in the widthwise direction. The prior art devices, however, have not yet succeeded in ensuring a sufficient degree of accuracy in controlling the thickness of rolled sheet materials in the widthwise direction. For this reason, it is a common practice for a certain degree of deterioration of product shape to be permitted as being unavoidable. Alternatively a multiplicity of working rolls having different initial crowns can be prepared in correspondence with the widths of the specific rolled sheet materials. Employing these methods leads to a deterioration in the quality of rolled products and to an increase in the unit price thereof.

In order to solve the above-described problems, U.S. Pat. No. 3,857,268 discloses a rolling mill having a roll arrangement in which the working rolls are adapted to be shifted along their axes for adjustment purposes in accordance with rolling conditions (e.g., the width of a sheet material to be rolled). The adjustment shift is combined with working-roll bending, to present a reasonable solution to the problem of rolled sheet materials being of irregular thicknesses even if the width of the sheet materials vary in a diverse manner.

Utilization of the working roll shift type rolling mill mentioned above as prior art enables the provision of schedule free rolling. Conventionally, in the case of a hot strip rolling mill, working rolls are subjected to unbalanced abrasion owing to the presence of the lateral edges of the rolled sheet material and there is, therefore, a limit to the number of sheet materials of the same width which can be rolled. In addition, the presence of this unbalanced abrasion unavoidably leads to choosing a rolling method referred to as "coffin schedule" in which sheet materials are rolled with the widths of the rolled products progressively narrowing. The aforesaid schedule free rolling is a method capable of eliminating the above-described limitation of the prior art. According to this schedule free rolling, it is possible not only to freely obtain rolled products having a required width as occasion demands, but also to couple a rolling mill directly to production facilities that are disposed upstream of the rolling mill for producing sheet materials to be rolled. Therefore, this feature enables effective utilization of thermal energy, thereby leading to the advantage that the production cost of the rolled products can be lowered.

As disclosed in the above cited U.S. Pat. No. 3,857,268, if an existing quadruple rolling mill for rolling hot strip materials is modified so that working rolls thereof may be shifted along their axes, the thickness of rolled sheet materials can be controlled with an adequate degree of accuracy in their widthwise direction, and it is also possible to provide schedule free rolling that imposes no limitation on the width range of sheet materials to be rolled.

However, in cases where hydraulic actuators for effecting working-roll bending are fixedly disposed on the housing of a rolling mill of the above-described working roll in the same manner as conventional rolling mills, the construction becomes such that hydraulic cylinders are disposed on blocks protruding into a window provided in the housing, the ( blocks being called "projecting blocks". In such cases, the presence of the projecting blocks serve to limit the performance of roll-changing the back-up rolls.

More specifically, although in the case of changing the rolls of a quadruple rolling mill, the changing of the working rolls is not time-consuming, when it comes to the reinforcing rolls. An old reinforcing roll needs to be lifted vertically in the housing to a predetermined position at which roll changing can be undertaken by engaging one end of the old roll with a roll changing C hook suspended from a crane. The old roll to be changed is then shifted from this roll changing position in the direction of its axis, and is thus removed from the housing. Then, a new reinforcing roll is placed in the housing in the reverse order.

However, if the projecting blocks having the hydraulic cylinder for effecting working-roll bending protrude into the window in the housing as in the case of rolling mills having the above-described arrangement, the presence of these projecting blocks causes difficulties when lifting the old reinforcing roll by means of the C hook. For this reason, each time the reinforcing rolls are changed, the projecting blocks must be disassembled and removed from the housing so as to allow the reinforcing rolls to be lifted. In consequence, changing of the reinforcing rolls requires a long period of time and the rolling must be brought to a halt during this changing operation.

In particular, if a rolling mill is of the hot strip rolling mill type, the stoppage of rolling necessitated by the aforesaid changing of the reinforcing rolls has a significant influence. A typical steelworks is only equipped with a single hot strip rolling mill. Accordingly, if the changing of the reinforcing rolls brings the operation of the hot strip rolling mill to a halt for a prolonged period, this has adverse results on the operating of various facilities disposed upstream and downstream of the mill.

SUMMARY OF THE INVENTION

Object of the Invention

It is therefore an object of the present invention to provide a working roll shift type rolling mill in which the changing of reinforcing rolls is facilitated.

It is another object of the present invention to provide a working roll shift type rolling mill in which hydraulic cylinders for effecting working-roll bending can be incorporated in a state in which changing of the reinforcing rolls is not precluded.

It is still another object of the present invention to provide a working roll shift type rolling mill in which the changing of the reinforcing rolls is easy and which succeeds in suppressing the application of any unbalanced load on the bearing boxes of the working rolls.

It is a further object of the present invention to provide a working roll shift type working mill in which, even when the arrangement of the working rolls is modified so that they can be freely shifted along the axes thereof, the hydraulic cylinders for effecting working-roll bending are disposed in such a manner that the changing of the reinforcing rolls is not precluded.

Brief Summary of the Invention

To these ends, the present invention provides a rolling mill which comprises a housing including: a pair of upper and lower working rolls having working roll chocks at their respective end portions; and a pair of upper and lower reinforcing rolls having reinforcing roll chocks at their respective end portions for supporting the associated working rolls. Shift devices are disposed to allow the upper and lower working rolls to shift in the direction of their respective axes, and hydraulic cylinder means for effecting working-roll bending are disposed in the respective upper and lower roll chocks provided at the opposite end portions of the upper and lower working rolls, the hydraulic cylinder means respectively including hydraulic rams being disposed so that one end of the respective hydraulic rams may be brought into contact with the opposing surfaces of the upper and lower working roll chocks positioned in face-to-face relationship with each other. The upper and lower reinforcing roll chocks provided at the respective end portions of the upper and lower reinforcing rolls and the upper and lower working roll chocks provided at the respective end portions of the upper and lower working rolls are disposed for vertical movement with their respective side surfaces facing the associated side walls of windows formed in the housing of the rolling mill.

The above and other objects, features and advantages of the present invention will become apparent from the following description of the preferred embodiments thereof, taken in conjunction will the accompanying drawings.

DESCRIPTION OF THE PREFERRED EMBODIMENT

The following description concerns a preferred embodiment of a rolling mill in accordance with the present invention in which working rolls thereof are arranged to freely shift along their axes.

Figure 1:
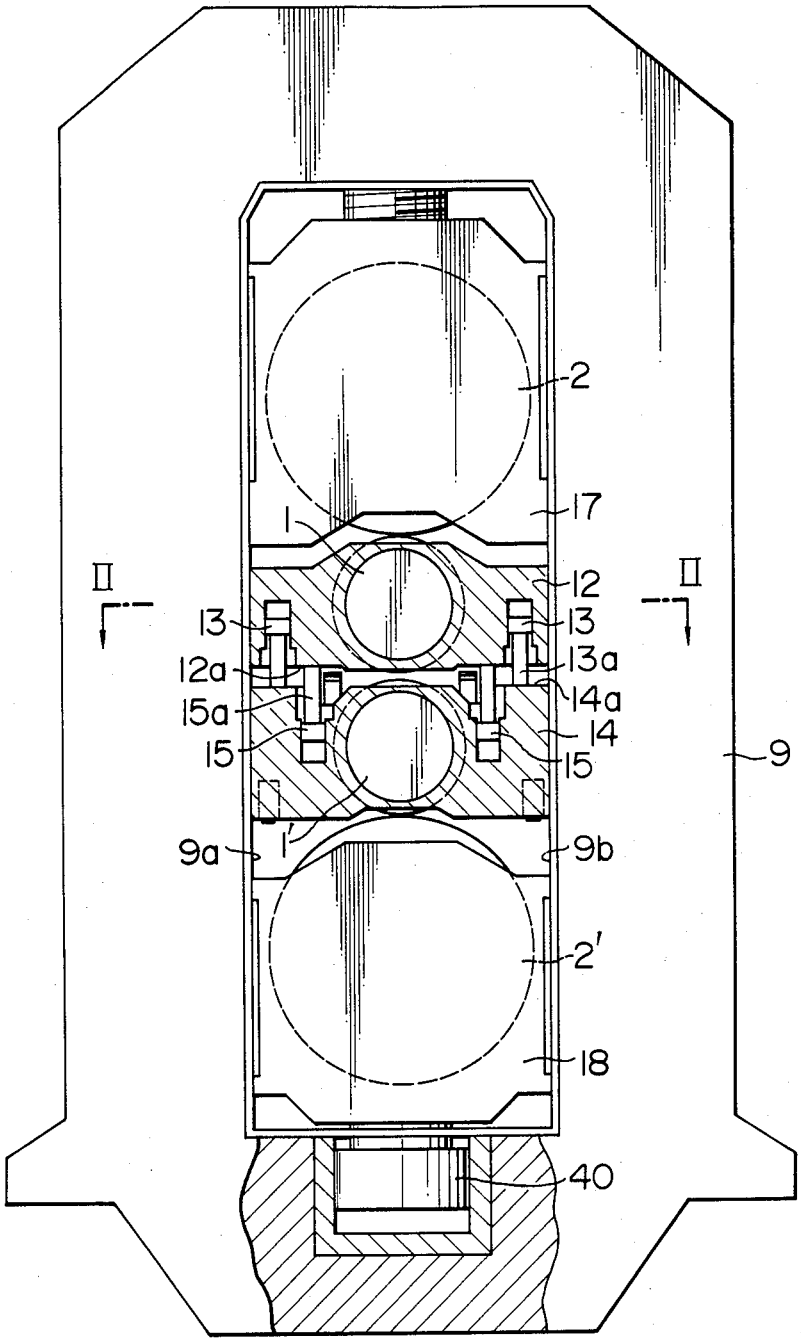
FIG. 1 is a front elevational view of a preferred embodiment of a working roll shift type quadruple rolling mill in accordance with the present invention.
Figure 2:
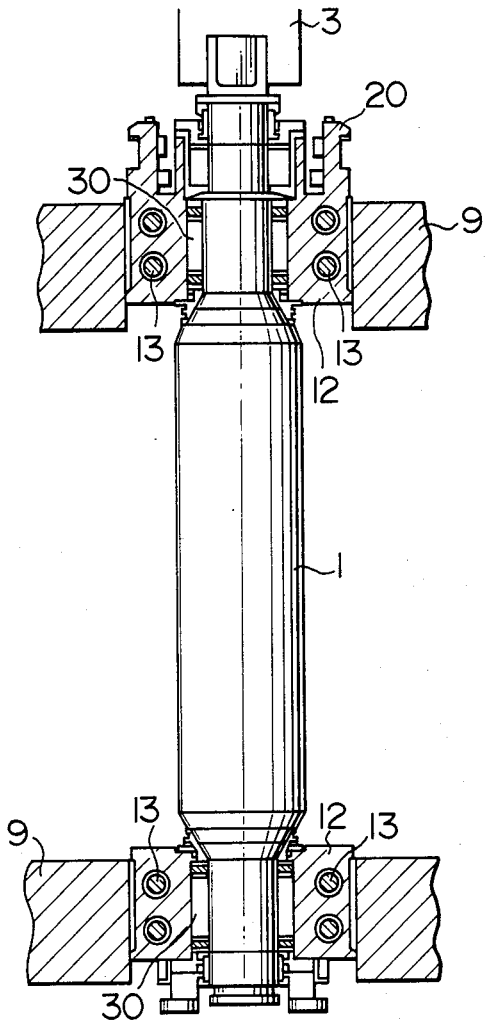
FIG. 2 is a view taken in the direcion of arrows II—II of FIG. 1.
Figure 3:
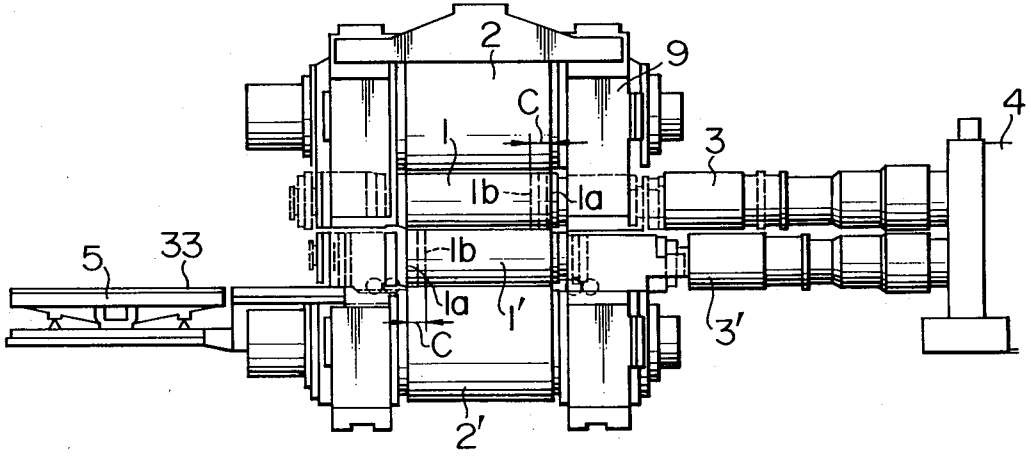
FIG. 3 is a side elevational view of the rolling mill shown in FIG. 1.
Figure 6:
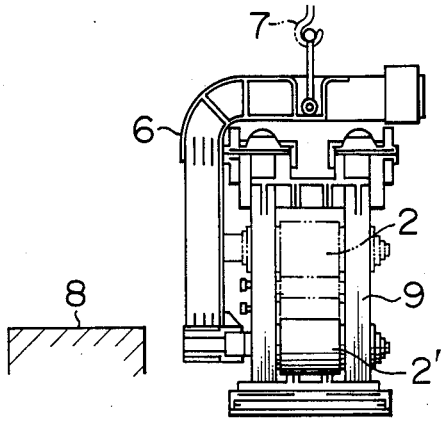
FIGS. 6 and 7 are respective illustrations used for explaining the procedure for changing the lower reinforcing roll of the working roll shift type rolling mill shown in FIG. 1.
Figure 7:
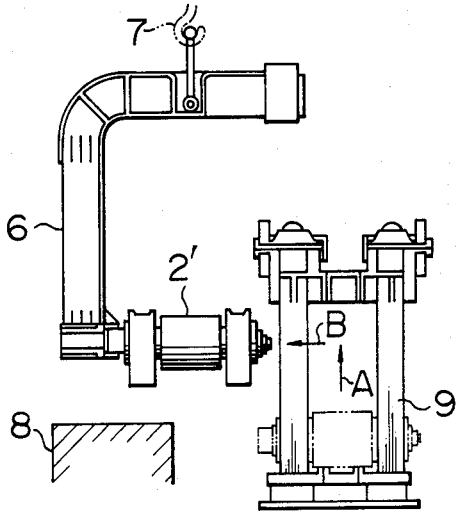

Referring to FIGS. 1 to 3, the illustrated rolling mill is a quadruple rolling mill incorporating a pair of upper and lower working rolls 1 and 1′ and another pair of upper and lower back-up rolls 2 and 2′. The working rolls 1 and 1′ are connected to a pinion stand 4 by spindle couplings 3 and 3′, and the pinion stand 4 is arranged to be driven by an electric motor (not shown). A working-roll changing apparatus 5 is disposed on the operation side of the illustrated rolling mill. The working-roll changing apparatus 5 is fixedly disposed in front of the rolling mill (or may be disposed for free movement in the direction of the axes of the rolls.) It is to be noted that a portable floor plate 33 is mounted on the working-roll changing apparatus 5 in front of the rolling mill. When the upper and lower back-up rolls 2 and 2′ are to be changed, the portable floor plate 33 is removed and a back-up roll changing C hook 6 shown in FIGS. 6 and 7 is fitted onto the vacant portion thus obtained.

Referring back to FIG. 1, a plurality of hydraulic actuators 13 and 15 are respectively incorporated in vertically facing upper and lower working roll chocks 12 and 14 and in spaced apart relationship in the direction in which a rolled sheet material is passed, the hydraulic actuators 13 and 15 being arranged to applying bending forces to the upper and lower working rolls 1 and 1′. One end of each hydraulic ram 13*a* constituting the hydraulic actuators 13 is brought into contact with a top surface 14*a* of a lower working roll chock 14. Similarly, while one end of each hydraulic ram 15*a* constituting the hydraulic actuators 15 is brought into contact with a bottom surface 12*a* of an upper working roll chock 12. The hydraulic rams 13*a* and 15*a* are slidable in the direction of the axes of the rolls. The hydraulic actuators 13 are disposed in the lower portion of the upper working roll chock 12 in spaced apart relationship in the direction in which a rolled sheet material is passed, and the hydraulic rams 13*a* of the hydraulic actuators 13 are brought into contact with the top surface 14*a* of the lower working roll chock 14. Therefore, the vertical forces generated by the hydraulic actuators 13 act to push up the upper working roll chock 12. On the other hand, the hydraulic actuators 15 are disposed in the upper portion of the lower working roll chock 14 in spaced apart relationship in the direction in which a rolled sheet material is passed, and the hydraulic rams 15*a* are brought into contact with the bottom surface 12*a* of the lower working roll chock 12. Therefore, the vertical forces generated by the hydraulic actuators 15 act to push down the lower working roll chock 14. By so doing, the upper and lower working rolls 1 and 1′ can be bent with complete control, thereby performing control of sheet thickness of the rolled sheet material in the widthwise direction.

Horizontal projections 17 and 18 in the direction of the roll axis are extended to have a sufficient coverage with respect to the amount of shift of the upper and lower working rolls 1 and 1′ in the direction of their axes. In a system having this structure, no projection exists in window planes 9*a* and 9*b* of a housing 9, so that the upper and lower back-up rolls 2 and 2' can be easily lifted up to a roll changing position along the window planes 9a and 9b of the housing 9 by means of the roll changing C hook 6. Accordingly, the upper and lower back-up rolls 2 and 2' can be changed without any difficulty. Incidentally, a reduction cylinder is indicated at 40.

FIG. 2 illustrates an assembled state in which the working roll 1 is attached to the housing 9. The upper and lower working roll chocks 12 and 14 positioned on a drive side are provided with working roll chock projections 20 and the projections 20 are used to axially shift the working rolls 1 and 1' by means of shift devices shown in FIG. 4 which will be described later. Incidentally, bearings are indicated by 30.

Referring to FIG. 3 illustrating the state of axial shift of the respective working rolls 1 and 1', solid lines 1a indicative of the positions of the ends of roll barrels represent the fact that the amount of axial shift of the working rolls 1 and 1' is zero. Dashed lines 1b are indicative of other positions of the ends of the roll barrels represent the fact that the aforesaid shift amount is equivalent to C.

Figure 5:
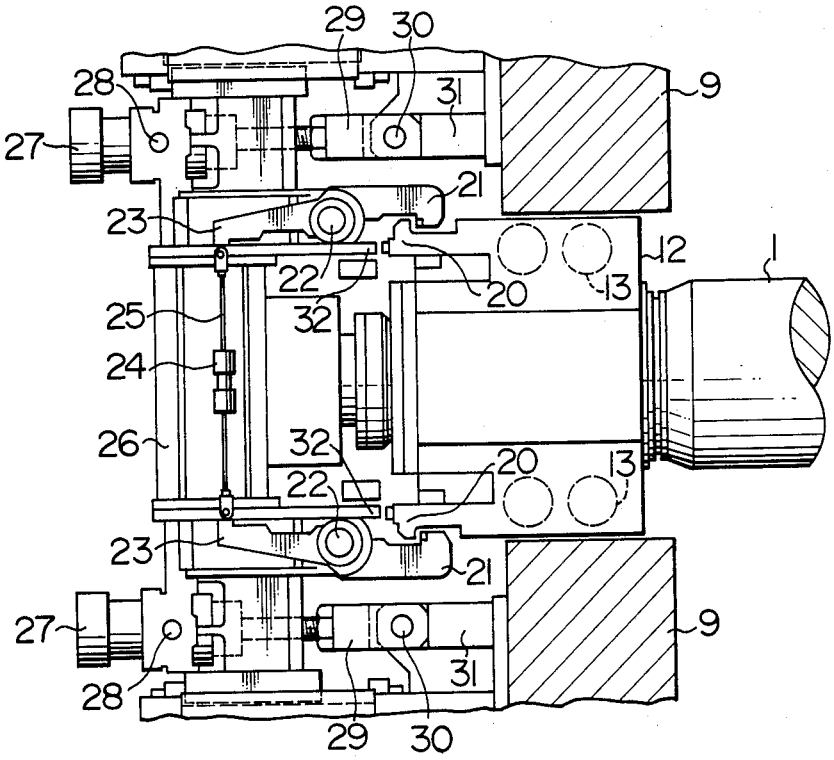
FIG. 5 is a top plan view of a shift mechanism in which the respective working rolls of the rolling mill shown in FIG. 1 are shifted along their axes.

Referring to FIG. 5 showing the working roll shift devices, the devices are illustratively disposed on the drive side of the rolling mill. The working roll chock projections 20 axially extend from the edges of the respective working roll chocks 12 and 14 which support the upper and lower working rolls 1 and 1'. A recess is formed in one side of each of the projections 20 and associated hooks 21 are adapted to engage with the recesses. The hooks 21 and the working roll chock projections 20 are brought into and out of engagement with each other by pivotally moving the hooks 21 about associated pins 22, the pivotal movement being caused through the intermediary of a rod 25, levers 23 and the pins 22 by operating a cylinder 24. The aforesaid hooks 21 are mounted on a beam 26 which is movably disposed along the axes of the rolls. One end of each shift cylinder 27 for shifting the beam 26 is attached to the opposite ends of the beam 26, and the other end of each of the shift cylinders 27 is secured to the housing 9 of the rolling mill by a coupling block 29, a pin 30 and a guide frame 31. The beam 26 is further provided with push rods 32 each having one end disposed in the vicinity of the facing projections 20 of the upper and lower working roll chocks 12 and 14. With this arrangement, when the shift cylinders 27 are actuated in the outward direction of the roll axis, the beam 26 is likewise shifted along the roll axis, thereby causing the working roll 1 to shift by means of the hooks 21 and the working roll chock projections 20 in the direction in which the working roll 1 is drawn out of the housing 9. On the other hand, when the shift cylinders 27 are actuated in the opposite direction, i.e., in the inward direction of the roll axis, the working roll 1 is caused to shift by means of the beam 26 and the push rods 32 in the direction in which the working roll 1 is pushed into the housing 9. In general rolling facilities, in a case where the working roll 1 is to be shifted, factors such as the amount per shift and the time interval between shifts are determined in accordance with each rolling schedule and are automatically set and function concurrently with the operation of the whole rolling facilities.

Figure 4A:
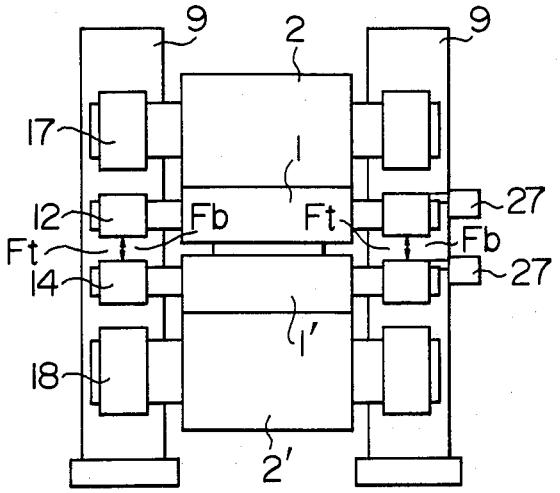
FIG. 4A illustrates the state of action of a roll-bending force under the conditions that the working rolls of the rolling mill shown in FIG. 1 are not relatively shifted.

The operation of the working roll shift type rolling mill constructed as described above will be described below with specific reference to FIGS. 4A and B. FIG. 4A shows a state wherein the upper and lower working rolls 1 and 1' are not relatively shifted, while FIG. 4B shows a state wherein the upper and lower rolls 1 and 1' are relatively shifted by a distance δ in the direction of the roll axis by virtue of the motion of shift devices 27.

As can be seen from the structure of the rolling mill shown in FIG. 1, the hydraulic actuators 13 and 15 are respectively disposed in the upper and lower working roll chocks 12 and 14 in spaced apart relationship in the direction in which a rolling sheet material is passed and the respective hydraulic rams 13a and 15a constituting the hydraulic actuators 13 and 15 are disposed at locations at which the rams 13a and 15a do not interfere with each other. Therefore, in cases where the upper and lower working rolls 1 and 1' are not relatively shifted as shown in FIG. 4A, if the bending force generated by the hydraulic actuators 13 in the upper working roll chocks 12 is $F_t$ with the bending force generated by the hydraulic actuators 15 in the lower working chocks 14 being $F_b$, an effect equivalent to $F_t+F_b$ can be achieved as the total roll bending force. In this case, the respective centers of application of the bending forces $F_t$ and $F_b$ correspond to the axial centers of bearings 30 disposed in the substantial centers of the respective working roll chocks 12 and 14.

Figure 4B:
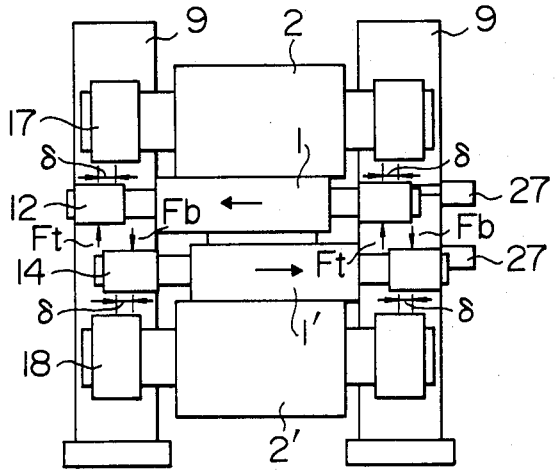
FIG. 4B is an illustration similar to FIG. 4A, but showing the state of action of the roll-bending force under the conditions that the working rolls of the rolling mill shown in FIG. 1 are relatively shifted.

In cases wherein the upper and lower working rolls 1 and 1' are shifted by the distance 6 along the roll axis as shown in FIG. 4B, the roll bending forces generated by the hydraulic actuators 13 and 15 each have the point of application in the respective centers of the bearings 30 supporting the working roll chocks 12 and 14, thereby exhibiting a force equivalent to $F_t+F_b$. Here, if calculation is made as to a moment M resulting from the bending force at the center of load applied to the bearings 30 for the upper working roll chock 14, then:

$$M=F_t\times O+F_b\times 2\delta=2F_b\delta \quad (1)$$

Since the bending force is $F_t+F_b$, if L is the moment arm length, then:

$$L=\frac{2F_b\delta}{F_t+F_b} \quad (2)$$

In general, since $F_t=F_b$, it follows that:

$$L=\delta \quad (3)$$

It is assumed here that the positions of the hydraulic actuators in the direction of the roll axis are fixed irrespective of the shift of the working rolls. In this case, the bending force generated by the hydraulic actuators is either $F_t$ or $F_b$, the moment arm length being δ. Specifically, as compared with this example, the rolling mill shown in FIG. 4B can output a two-fold bending force with respect to the same amount of shift δ while the moment arm length is the same. Conversely, if the strength of the bearings 30 supporting the working roll 1 is liited, it is possible to reduce the bearing strength to a half level in order to output the same level of bending force.

The operation of changing the upper and lower back-up rolls 2 and 2' will be described below with specific reference to FIGS. 6 and 7. When the lower back-up roll 2' is to be changed, the C hook 6 is transported by a ceiling crane 7 and, as shown in FIG. 6, is inserted into the back-up roll 2. However, since components indicated collectively at 8, such as the working-roll changing apparatus 5, are disposed in front of the rolling mill, it is impossible to horizontally shift the back-up roll 2. Therefore, as shown in FIG. 7, the lower back-up roll 2' is first lifted vertically in the direction of an arrow A up to a height sufficient to allow horizontal shift of the roll 2'. Subsequently, the roll 2' is shifted in the direction of an arrow B, thereby removing the old back-up roll 2'. The operation of incorporating a new back-up roll 2' is performed in the order reverse to the above-described procedure.

Therefore, as is evident from the presently preferred embodiment, in the rolling mill of this invention in which the working rolls are adapted to axially shift, it is possible to provide high-precision control of thickness of rolled sheet materials by virtue of the consistently exact setting of a roll bending force. In addition, since there is no projection in the windows of the housing, after the back-up roll to be changed has been lifted upwardly in the window by a lifter means such as a C hook, the back-up roll is shifted horizontally at a suitable position, thereby enabling the changing of the back-up rolls. Also, it is possible to incorporate a shift mechanism for the working rolls without interfering with the working roll changing apparatus, outlet and inlet guides and piping.

In addition, although the projecting blocks have heretofore been required, they are not needed in the present invention, and back-up roll chocks are necessitated for working purposes alone. It is therefore possible to minimize the modification cost required for modification of a conventional rolling mill into the working roll shift type arrangement according to the presently preferred embodiment. Moreover, the hydraulic actuators are disposed in the upper and lower working roll chocks, and since the force generated by the hydraulic actuators respectively act directly on the facing working roll chocks without using any projecting blocks as an intermediary. It is accordingly possible to substantially double the output level of the hydraulic actuators as compared with the prior-art methods.

As described above, the present invention possesses the advantage of achieving a working roll shift type rolling mill in which the hydraulic actuators for effecting working-roll bending are disposed so that they are applicable to working roll shift type rolling mills and in addition in which the hydraulic actuators can be disposed in such a manner that they do not interfere with the changing of the back-up rolls.

What is claimed is:

1. A working roll shift type rolling mill having a housing, and including upper and lower working rolls having working roll chocks at their respective end portions, and upper and lower reinforcing rolls shaving reinforcing roll chocks at their respective end portions for supporting said working rolls, comprising:

shift device means for shifting said upper and lower working rolls in the direction of their respective axes;

hydraulic cylinder means for effecting working-roll bending disposed in said respective upper and lower roll chocks, said hydraulic cylinder means respectively including hydraulic rams disposed so that one end of said respective hydraulic rams may be brought into contact with opposing surfaces of said upper and lower working roll chocks positioned in face-to-face relationship with each other;

each of said working roll chocks being respectively immovably mounted to the associated working roll such that said working roll chocks are axially shifted together with the respective one of said working rolls;

said housing having window means including side walls; and said upper and lower reinforcing roll chocks and said upper and lower working roll chocks having side surfaces facing associated ones of said side walls of said window means to allow for vertical movement of each of the rolls within said housing.

2. A working roll shift type rolling mill having a housing including upper and lower working rolls having working roll chocks at their respective end portions and upper and lower reinforcing rolls having reinforcing roll chocks at their respective end portions for supporting said working rolls, comprising:

shift device means mounted between said housing and the respective one of said working roll chocks to allow for shifting said upper and lower working rolls in the direction of their respective axes;

hydraulic cylinder means for effecting working roll bending mounted between opposing sides of said upper and lower working roll chocks that are adjacent to each other at the opposite end portions of said upper and lower working rolls, said hydraulic cylinder means respectively including hydraulic rams each having an end engaging a respective one of the opposing sides of said upper and lower working roll chocks that are adjacent to each other;

said working roll chocks being respectively immovably mounted to the associated working roll such that said working roll chocks are axially shifted together with the respective one of said working rolls;

said housing having window means including side walls; and said respective hydraulic cylinder means disposed in said upper working roll chocks and said respective hydraulic cylinder means disposed in said lower working roll chocks being arranged in spaced apart relationship in a direction in which a sheet material to be rolled is passed, said housing of said rolling mill further including windows each having a flat shaped side wall such that said upper and lower reinforcing roll chocks and said upper and lower working roll chocks may be lifted and lowered in the vertical direction.

3. A working roll shift type rolling mill having a housing including upper and lower working rolls having working roll chocks at their respective end portions and upper and lower reinforcing rolls having reinforcing roll chocks at their respective end portions for supporting said working rolls, comprising:

shift device means for shifting said upper and lower working rolls relative to each other in the direction of their respective axes;

hydraulic cylinder means mounted between vertically facing portions of said upper and lower working roll chocks for applying a vertical force to the vertically facing portions at the opposite end portions of said upper and lower working rolls one of each of said vertically facing portions having a horizontal wall surface;

said upper and lower working roll chocks being immovably mounted on said respective working rolls so that the working roll chocks can be shifted along their axes together with said upper and lower working rolls;

said hydraulic cylinder means including a hydraulic rams each having an end engaging one of said horizontal wall surfaces of said upper and lower working roll chocks, said respective working roll chocks and said reinforcing roll chocks having flat shaped side surfaces, and said housing of said rolling mill further including windows each having flat shaped side walls such that said upper and lower working roll chocks and said upper and lower reinforcing roll chocks may be lifted and lowered.

4. A working roll shift type rolling mill as claimed in claim 3, wherein each of said hydraulic ram ends have means for slidably engaging said horizontal wall surfaces of said upper and lower working roll chocks for permitting axial shifting between corresponding ones of said upper and lower working roll chocks while allowing for application of the vertical forces in shifted positions of the upper and lower working rolls.

5. A roll shift type rolling mill having a housing including upper and lower working rolls having working roll chocks at their respective end portions and upper and lower reinforcing rolls having reinforcing roll chocks at their respective end portions for supporting said working rolls, comprising:

shift device means on said housing for shifting said respective upper and lower working rolls relative to each other in the direction of their respective axes;

said working roll chocks being immovably mounted to their associated working rolls such that said working roll chocks are axially shifted together with a corresponding one of said working rolls;

first hydraulic cylinder means for applying vertical forces to the bottom portions of said upper working roll chocks including first hydraulic rams, and second hydraulic cylinder means for applying vertical forces to the top portion of said lower working roll chocks including second hydraulic rams, one end of said first hydraulic rams being mounted in said upper working roll chocks and the other end of each of said first hydraulic rams engaging a top surface of said lower working roll chocks, and one end of each of said second hydraulic rams being mounted in said lower working roll chocks and the other end of each of said second hydraulic rams engaging a bottom surface of said upper working roll chocks, said upper and lower working roll chocks and said upper and lower reinforcing roll chocks having substantially the same width in the direction in which a roller material is passed, said housing further including windows each having a flat side wall such that said upper and lower working roll chocks and said upper and lower reinforcing roll chocks may be lifted and lowered within said windows.

6. A working roll shift type rolling mill as claimed in claim 5, wherein said other end of each of said first hydraulic rams and said other end of each of said second hydraulic rams have means for slidably engaging respective ones of said top surface and said bottom surfaces respectively of said upper and lower working roll chocks for permitting axial shifting between corresponding ones of said upper and lower working roll chocks while allowing for application of the vertical forces in shifted position of the upper and lower working rolls.

7. A working roll shift type rolling mill having a housing including upper and lower working rolls having working roll chocks at their respective end portions, and upper and lower reinforcing rolls for supporting said respective upper and lower working rolls, each of said reinforcing rolls having reinforcing roll chocks at their respective end portions, comprising:

shift device means mounted on said housing for shifting said upper and lower working rolls in the direction of their axes;

each of said working roll chocks being immovably mounted to the corresponding one of the working rolls such that said working roll chocks are axially shifted together with said corresponding one of said working rolls;

hydraulic cylinder means mounted between said upper and lower working roll chocks respectively at each end of said working rolls for working-roll bending including applying vertically directed bending forces to said upper and lower working rolls, said hydraulic cylinder means including a plurality of actuators acting directly between respective ones of said upper and lower working roll chocks on an associated one of the adjacent surfaces of said upper and lower working roll chocks mounted in said housing in face-to-face relationship with each other;

said housing of said rolling mill further including windows each having a smooth surface side wall such that said upper and lower working roll chocks and corresponding upper and lower working rolls and upper and lower reinforcing roll chocks and corresponding upper and lower reinforcing rolls are slidable within said housing in the vertical direction.

8. A working roll shift type rolling mill as claimed in claim 7, wherein said actuators have end portion means for engaging portions of respective ones of said adjacent surfaces of said upper and lower working roll chocks for permitting axial shifting between corresponding ones of said upper and lower working roll chocks while allowing for application of the vertical forces in shifted positions of the upper and lower working rolls.

* * * * *